United States Patent [19]

Ohmura et al.

[11] Patent Number: 4,913,102

[45] Date of Patent: Apr. 3, 1990

[54] CONTROL DEVICE FOR HYDRAULICALLY DRIVEN COOLING FAN OF VEHICLE ENGINE HAVING RELIEF PASSAGE FOR COLD START

[75] Inventors: Seiji Ohmura; Yuji Itoh, both of Toyota, Japan

[73] Assignee: Toyota Jidosha Kabushiki Kaisha, Aichi, Japan

[21] Appl. No.: 330,307

[22] Filed: Mar. 29, 1989

[30] Foreign Application Priority Data

Apr. 6, 1988 [JP] Japan ..... 63-84341

[51] Int. Cl.[4] ..... F01P 7/02

[52] U.S. Cl. ..... 123/41.12; 417/292; 417/310

[58] Field of Search ..... 123/41.05, 41.06, 41.09, 123/41.11, 41.12, 41.44, 41.49; 60/456; 417/292, 310

[56] References Cited

U.S. PATENT DOCUMENTS 4,446,697 5/1984 Goscenski, Jr. ..... 123/41.12

4,798,177 1/1989 Oomura et al. ..... 123/41.12

FOREIGN PATENT DOCUMENTS 62-200185 12/1987 Japan .

*Primary Examiner*—Noah P. Kramen

*Attorney, Agent, or Firm*—Kenyon & Kenyon

[57] ABSTRACT

In a device for controlling the flow rate of a hydraulic operating fluid from a pump to a hydraulic motor for driving an engine cooling fan in a vehicle by modifying either the cross sectional opening area of a variable flow constriction means in the fluid conducting passage while maintaining a constant pressure difference across the flow constriction means by a pressure control valve responsive to the pressure difference across the flow constriction means or the pressure difference by selectively partly leaking the pressure transmitted from the downstream side of the flow constriction means to a rear side of the pressure control valve, a cold state relief means is provided to temporarily relieve the rear side of the pressure control valve at cold start of the engine to avoid abnormally high fluid pressure being supplied to the motor due to delayed response of the pressure control valve under high viscosity of the operating fluid at low temperature.

4 Claims, 2 Drawing Sheets

CONTROL DEVICE FOR HYDRAULICALLY DRIVEN COOLING FAN OF VEHICLE ENGINE HAVING RELIEF PASSAGE FOR COLD START

BACKGROUND OF THE INVENTION

1. Field the the Invention

The present invention relates to a control device for a hydraulically driven cooling fan of an engine in a vehicle such as an automobile.

2. Description of the Prior Art

For an internal combustion engine in a vehicle such as an automobile, it has already been thought of to drive a cooling fan for supplying cooling draft to the radiator of the engine by a hydraulically driven motor such as an oil-hydraulic motor, and to control the rotation rate of the motor according to an engine temperature parameter such as engine coolant temperature, as disclosed in, for example, Japanese Utility Model Publication Sho 49-40183 (1974) and Japanese Patent Laying Open Publication Sho 58-13119 (1983).

In such a hydraulically driven cooling fan the rotation rate of the fan is controlled by the flow rate of the hydraulic operating fluid supplied to the hydraulic motor.

As a control device for controlling the rotation rate of such a hydraulically driven cooling fan it has been thought of to provide a flow constriction means in a passage for conducting the hydraulic operating fluid from a pump to the hydraulic motor, a first pressure chamber on an upstream side of the flow constriction means along the flow direction of the fluid from the pump to the motor, a second pressure chamber on a downstream side of the flow constriction means opposite to said upstream side, and a pressure control means responsive to the pressure difference between the first and the second pressure chamber so as to leak selectively part of the fluid from the upstream side of the flow constriction means when the pressure difference increases beyond a preset value so as thereby to maintain a constant pressure difference across the flow constriction means, wherein the cross sectional opening area through the flow constriction means is varied by a variable lift control means such as a linear solenoid valve according to the requirement for the draft of the fan.

Such a control device for the hydraulically driven fan operates satisfactorily to control the rotation rate of the fan under normal operating condition of the vehicle. However, when the engine is started at cold state, the pressure of the fluid supplied to the pump can temporarily rise to an abnormally high pressure due to a delay in selectively leaking part of the operating fluid from the upstream side of the flow constriction means caused by high viscosity of the operating fluid at low temperature. Particularly when a smoothing choke means is provided in the passage transmitting the fluid pressure from the downstream of the flow constriction means to the second pressure chamber to prevent hunting of the control device, the choke means presents high flow resistance against the transmittance of the pressure to the second pressure chamber, and therefore the pressure control operation by the pressure control means is further delayed. Such abnormal rise of the hydraulic pressure deteriorates the fuel consumption of the vehicle and the durability of the hydraulic motor.

When the pump has a built-in relief valve, such abnormal rise of the hydraulic pressure can be avoided.

However, when the cooling fan is subject to a high driving draft during high speed driving, the fan rotates by itself at a high rate, whereupon the hydraulic motor for driving the cooling fan operates as a pump, and therefore the pump will try to increase the pump output flow rate until the pump output pressure reaches the pressure determined by the relief valve, and therefore the rate of intake flow of the operating fluid from the operating fluid tank to the pump will correspondingly increase, and the rotation rate of the hydraulic motor will increase, and there is a danger that the durability problems of the pump is seriously damaged.

SUMMARY OF THE INVENTION

The object of the present invention is to solve these problems, and and to provide a control device for a hydraulically driven fan of an internal combustion engine in a vehicle that is improved not to cause such abnormal rise of the pressure of operating fluid at cold starting of the engine while avoiding such a trouble that very high rate rotation of the pump is induced by the driving draft during high speed driving of the vehicle.

The above object is achieved according to the present invention by a control device for a hydraulically operated cooling fan of an internal combustion engine in a vehicle having a hydraulic motor for driving said fan and a hydraulic pump for delivering a flow of a hydraulic operating fluid at an elevated pressure for driving said hydraulic motor, comprising: a flow constriction means provided in a passage for conducting said operating fluid from said pump to said motor, a first pressure chamber connected with said passage at an upstream side of said flow constriction means along the direction of flow of said operating fluid through said passage, a second pressure chamber connected with said passage at a downstream side of said flow constriction means opposite to said upstream side, a pressure control means responsive to a pressure difference of said operating fluid across said flow constriction means so as to leak selectively part of said operating fluid out of said passage at said upstream side of said flow constriction means when said pressure difference exceeds a predetermined value, a flow control means for variably modifying either the cross sectional opening area of said flow constriction means or the transmittance of the pressure of said operating fluid at the downstream side of said flow constriction means to said second pressure chamber by selectively partly leaking the pressure to be transmitted according to requirement for the draft provided by said fan, and a cold start control means which opens said second pressure chamber to a pressure relief passage when the engine is started at cold state.

According to the above construction, said second pressure chamber is widely open to the relief passage when the engine is started at cold state, and therefore, even when the operating fluid is cold and has high viscosity, the pressure control valve will swiftly move to leak the operating fluid out of the fluid passage at the upstream side of the flow constriction means before the pressure of the operating fluid in said first pressure chamber rises to a certain pressure set for the normal operation based upon normal pressure difference between the upstream side and the downstream side of the flow constiction means. The cold state of the engine may be determined according to any conventional concept in this art and may be detected by any conventional detecting means such as a temperature sensor for the engine coolant. Regardless of some changes in the definition of the cold state of the engine, generally during cold starting of the engine the engine cooling fan need not be driven, and therefore it will cause no problem that the supply of operating fluid to the hydraulic motor for driving the fan is in any event substantially stopped for a while at cold starting of the engine. The operation of such a cold start control means may be terminated according to any control concept such as to preset a certain period, to detect a warming up condition of the engine, etc..

According to a particular embodiment of the present invention said flow control means may be a variable lift valve means having a linear solenoid actuator for driving a variable lift valve element which modifies the transmittance of the pressure of said operating fluid at the downstream side of said flow constriction means to said second pressure chamber according to the magnitude of lift of said valve element, and said cold start control means may be incorporated in said variable lift valve means so as to provide a maximum lift of said valve element when said colt start control means is operated.

Further, said pressure control means may include a pressure relief valve means for opening said second pressure chamber to a drain passage when the pressure in said second pressure chamber rises beyond a predetermined value.

Further, said pressure relief passage may desirably be connected with an inlet port of said pump. By this arrangement said operating fluid in said first pressure chamber is positively drawn out of said first pressure chamber by the suction of said pump when said first pressure chamber is relieved at cold start of the engine.

BRIEF DESCRIPTION OF THE DRAWINGS

In the accompanying drawings.

DESCRIPTION OF THE PREFERRED EMBODIMENT

The present invention will now be described in detail with respect to some preferred embodiments with reference to the accompanying drawings.

Figure 1:
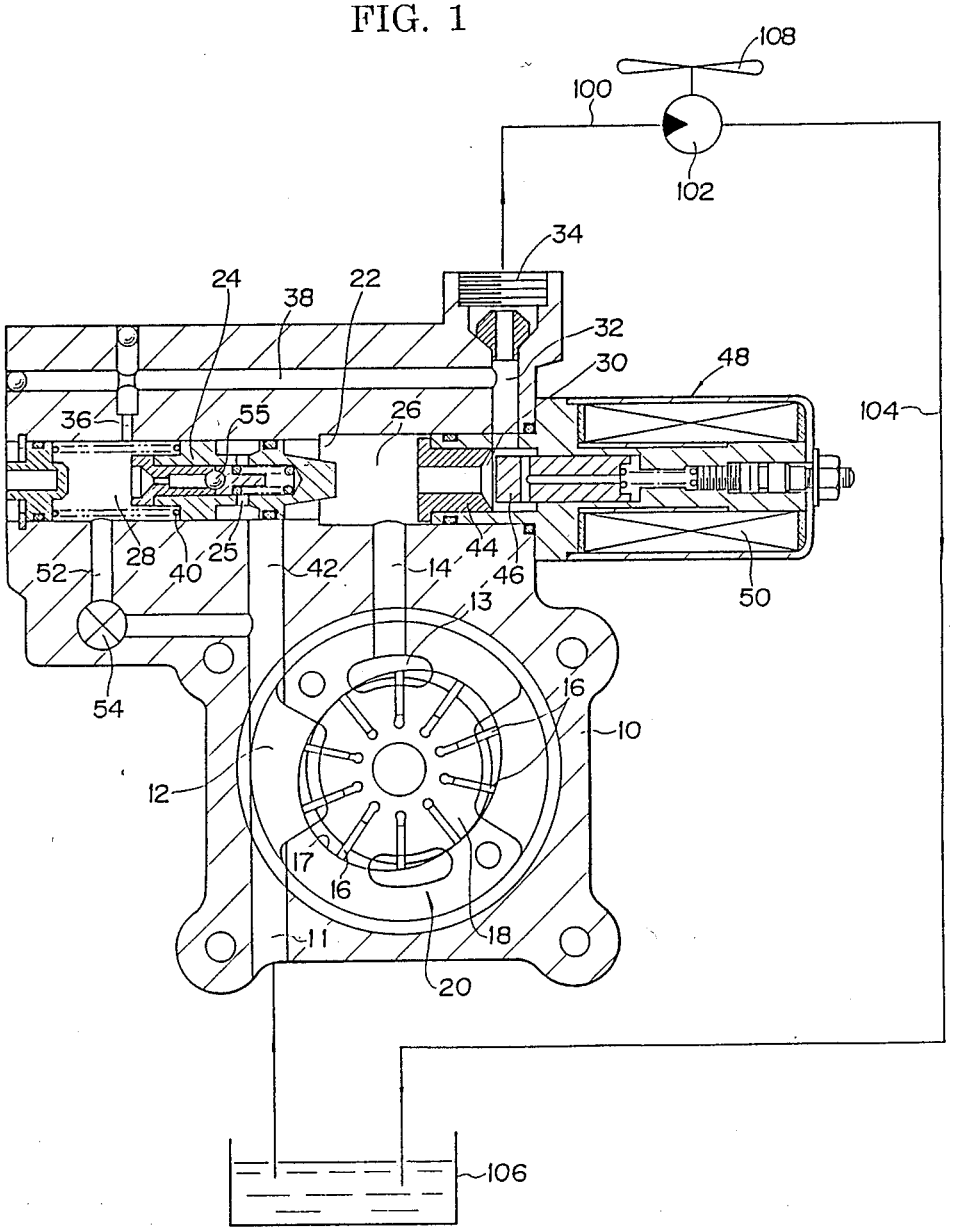
FIG. 1 is a longitudinally sectional view showing a first embodiment of a control device for a hydraulically operated cooling fan according to the present invention.

Referring to FIG. 1 showing a first embodiment of the control device for a hydraulically operated cooling fan according to the present invention, the pressure control device is incorporated in a single housing assembly 10 together with a pump for pumping the hydraulic fluid for driving the engine fan. The housing assembly has an inlet passage 11, an inlet port 12, an outlet port 13 and an outlet passage 14, and receives in a pumping chamber 17 a rotor 18 having a plurality of vanes 16 and rotatable therein, thus forming a vane pump 20. The rotor 18 is rotationally driven by an internal combustion engine not shown in the figure, so that an operating fluid in a reservoir 106 is taken in to the pumping chamber through the inlet passage 11 and the inlet port 12 and is delivered therefrom through the outlet port 13 and the outlet passage 14.

A valve bore 22 for the pressure control device is formed in the housing assembly 10. In the valve bore 22 a spool valve member 24 is provided to be movable in the axial direction thereof, and the inside space of the valve bore 22 is divided into a first pressure chamber 26 and a second pressure chamber 28. The outlet passage 14 of the vane pump 20 is connected directly to the first pressure chamber 26, and the output pressure of the vane pump 20. The first pressure chamber 26 communicates through a variable flow constriction means 30 (described in more detail hereinunder) and a fluid passage 32 with an operating fluid outlet port 34 provided in the housing assembly 10.

The operating fluid outlet port 34 is connected by a passage 100 with a hydraulic motor 102 which receives the operating fluid through the passage 100 and returns the operating fluid though a passage 104 toward the reservoir 106, and is driven by the flow of the operating fluid rotationally thereby to drive a cooling fan 108.

The second pressure chamber 28 is connected with the passage 32 through a throttled passage 36 and a passage 38, and is supplied with the operating fluid pressure at the downstream side of the variable flow constriction means 30.

The spool valve member 24 moves in the axial directions in the bore 22 according to the pressure difference between the first pressure chamber 26 and second pressure chamber 28, and when the pressure in the first pressure chamber 26 exceeds the pressure in the second pressure chamber 28 by at least a preset value, then it moves from the position shown in the figure to the left by overcoming the spring force of a compression coil spring 40, and communicates the first pressure chamber 26 with a relief passage 42 formed in the housing assembly 10, whereas otherwise it is positioned as shown in the figure by the compression coil spring 40 so as to cut the communication between the first pressure chamber 26 and the relief passage 42. The relief passage 42 communicates with the inlet port 12 of the vane pump 20.

Thus, under normal operating condition the pressure difference between the first pressure chamber 26 and the second pressure chamber 28 is maintained at an approximately constant value determined by the spring force of the compression coil spring 40. Therefore, the flow rate of the operating fluid supplied to the motor 102 is determined by the effective passage cross sectional area of the variable flow constriction means 30, and this effective passage cross sectional area is determined by the position of a valve element 46 which is movable relative to a valve seat 44 fixedly mounted in the housing assembly 10. The valve element 46 is driven in the direction to approach to or depart from the valve seat 44 by a linear solenoid actuator 48 fitted to the housing assembly 10, and thus the effective passage cross sectional area of the variable flow constriction means 30 is controlled quantitatively according to the electric current supplied to a solenoid coil 50 of the linear solenoid actuator 48.

The electric current supplied to the solenoid coil 50 of the linear solenoid actuator 48 may be controlled depending on various parameters such as coolant temperature so as to control the rotation rate of the cooling fan 108 according to the requirement for th draft provided by the cooling fan.

The housing assembly 10 is provided with a relief passage 52 which directly connects the second pressure chamber 28 with the relief passage 42, and a temperature sensitive valve 54 which controls the communication of the relief passage 52. The temperature sensitive valve 54 may be a thermo wax type temperature sensitive valve which controls the opening of a through passage thereof according to the temperature sensed by a thermally expansible wax element thereof so that the through passage is opened when the wax element is sensing a temperature lower than a predetermined temperature indicating a certain cold state of the engine.

According to the above construction, when the temperature of the operating fluid is low in a cold state of the engine, the temperature sensitive valve 54 is opened to communicate the relief passage 52, and therefore, even when the operating fluid filling the second pressure chamber 28 and the passages 36 and 38 is cold and highly viscous at the time of cold starting of the engine, the fluid in the second pressure chamber 28 is readily removed therefrom through the relief passage 52 when the fluid pressure in the first pressure chamber 26 begins to rise by the rotation of the rotor 18. In this case the removal of the fluid from the second pressure chamber 28 is more expedited by the suction applied from the inlet port 12 through the relief passage 52. Thus, the valve element 24 can swiftly move leftward in the figure to open the relief passage 42 when the fluid pressure in the first pressure chamber 26 rises beyond a certain preset value even under cold starting of the engine.

By the above described operation, even during cold starting, any supply of operating fluid at high pressure to the hydraulic motor 102 is avoided.

In the embodiment shown in FIG. 1, the spool valve member 24 has a ball type relief valve 55 for communicating the second pressure chamber 28 to the relief passage 42 through a hole 25 when the pressure in the second pressure chamber 28 rises abnormally. This relief valve 55 provides a further safety of relieving the downstream side of the pressure constriction means 30 from abnormal high pressure even when the relief valve 54 failed to open because of some troubles.

Figure 2:
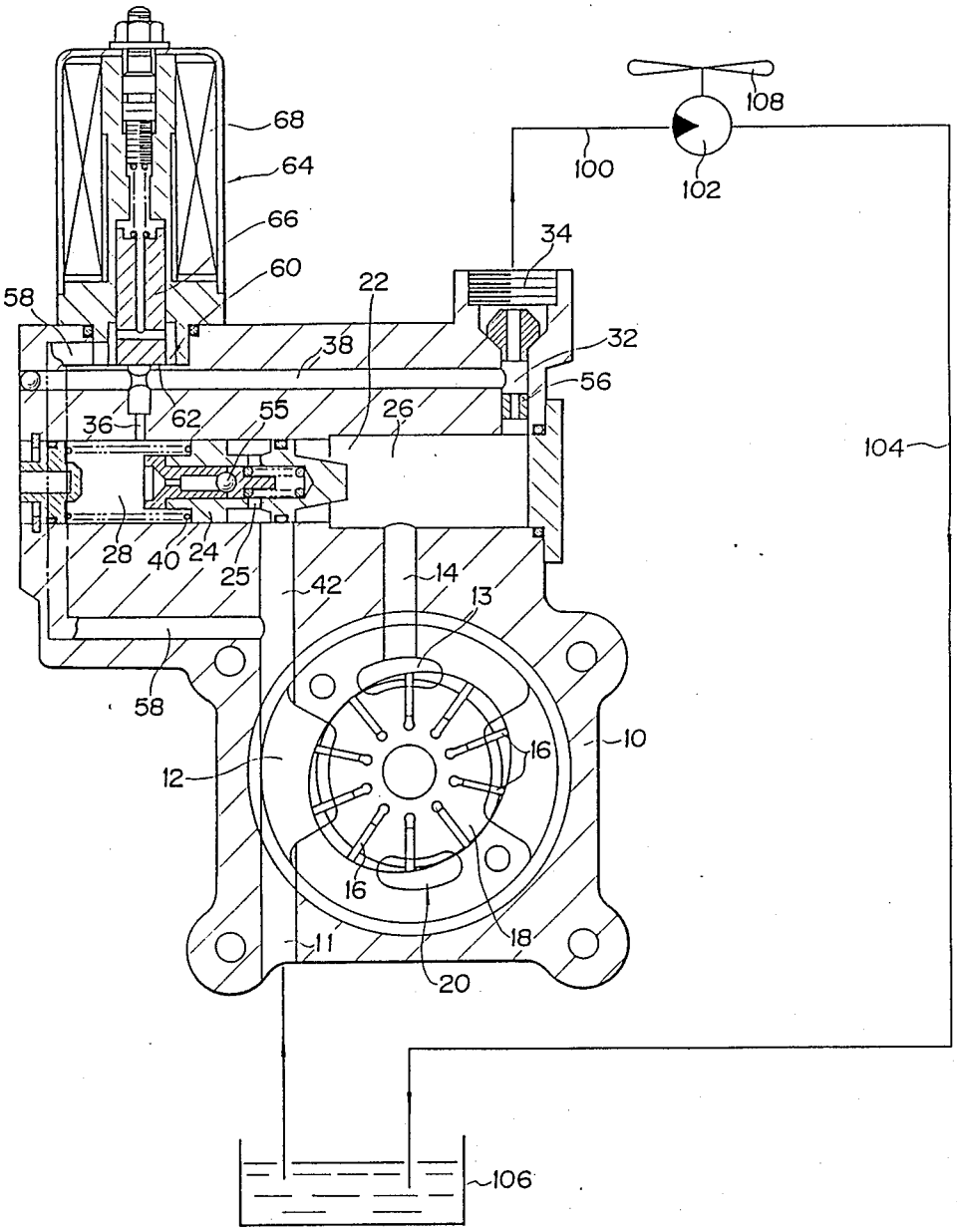
FIG. 2 is a view similar to FIG. 1 showing a second embodiment of a control device for a hydraulically operated cooling fan according to the present invention.

FIG. 2 shows another embodiment of the control device for a hydraulically driven cooling fan according to the present invention. In FIG. 2, the portions corresponding to those shown in FIG. 1 are given the same reference numerals as in FIG. 1. In this second embodiment the variable flow constriction means 44 in the embodiment shown in FIG. 1 is replaced by a fixed constriction means 56, and a variable flow constiction means 60 is provided to variably modify the pressure transmitted from the downstream side of the fixed flow constriction means 56 to the second pressure chamber 28 by the low pressure or vacuum from the inlet port 12 of the vane pump 20, so as thereby to control the pressure difference across the fixed flow constriction means 56 and accordingly the flow of operating fluid supplied through the fixed flow constriction means 56 to the hydraulic motor 102.

The variable flow constriction means 60 has a fixed valve seat 62 having a port opening 63 and a valve element 66 adapted to be driven in the vertical direction in the figure by a linear solenoid actuator 64 so as quantitatively to vary the effective opening of the valve port 63 according to the electric current supplied to a solenoid coil 68 thereof. The electric current to the solenoid coil 68 is controlled depending on various parameters such as coolant temperature so that the rotation rate of the fan or the flow rate of the operating fluid to the motor 102 is varied according to the requirement for the drafted provided by the fan. In the shown embodiment, the valve element 66 moves upward in the figure so as to increase the opening degree of the valve port 63 along with increase of the electric current supplied to the solenoid coil 68. The upper side of the valve port 63 in the figure is connected with the inlet port 12 of the vane pump 20 by a relief passage 58.

When the coolant temperature is below a certain temperature to cause high viscosity of the operating fluid such as at the cold starting of the engine, the valve port 63 of the variable flow constriction means 60 is fully opened by full supply of electric current to the solenoid coil 68 so that the second pressure chamber 28 is fully connected with the inlet port 12 of the vane pump 20. Therefore, the operating fluid filling the second chamber 28 is readily transferred toward the inlet port 12 even in a cold and viscous state if the fluid pressure in the first pressure chamber 26 is going to rise up to abnormally high pressure so that the first pressure chamber 26 is opened to the relief passage 42.

Although the present invention has been described with respect to some preferred embodiments thereof, it is to be noted that various modifications would be possible with these embodiments by one of those skilled in the art without departing the spirit of the invention.

We claim:

1. A control device for a hydraulically operated cooling fan of an internal combustion engine in a vehicle having a hydraulic motor for driving said fan and a hydraulic pump for delivering a flow of a hydraulic operating fluid at an elevated pressure for driving said hydraulic motor, comprising: a flow constriction means provided in a passage for conducting said operating fluid from said pump to said motor, a first pressure chamber connected with said passage at an upstream side of said flow constriction means along the direction of flow of said operating fluid through said passage, a second pressure chamber connected with said passage at a downstream side of said flow constriction means opposite to said upstream side, a pressure control means responsive to a pressure difference of said operating fluid across said flow constriction means so as to leak selectively part of said operating fluid out of said passage at said upstream side of said flow constriction means when said pressure difference exceeds a predetermined value, a flow control means for variably modifying either the cross sectional opening area of said flow constriction means or the transmittance of the pressure of said operating fluid at the downstream side of said flow constriction means to said second pressure chamber by selectively partly leaking the pressure to be transmitted according to requirement for the draft provided by said fan, and a cold start control means which opens said second pressure chamber to a pressure relief passage when the engine is started at cold state.

2. A control device according to claim 1, wherein said flow control means is a variable lift valve means having a linear solenoid actuator for driving a variable lift valve element which modifies the transmittance of the pressure of said operating fluid at the downstream side of said flow constriction means to said second pressure chamber according to the magnitude of lift of said valve element, and said cold start control means is incorporated in said variable lift valve means so as to provide a maximum lift of said valve element when said colt start control means is operated.

3. A control device according to claim 1, wherein said pressure control means includes a pressure relief valve means for opening said second pressure chamber to a drain passage when the pressure in said second pressure chamber rises beyond a predetermined value.

4. A control device according to claim 1, wherein said pressure relief passage is connected with an inlet port of said pump.

* * * * *